United States Patent [19]

Coad et al.

[11] Patent Number: 4,470,895

[45] Date of Patent: Sep. 11, 1984

[54] COATINGS FOR CUTTING IMPLEMENTS

[75] Inventors: Joseph P. Coad, Uffington; Samuel R. Keown, Wath upon Dearne, both of England

[73] Assignee: United Kingdom Atomic Energy Authority, England

[21] Appl. No.: 477,778

[22] Filed: Mar. 22, 1983

[30] Foreign Application Priority Data

Mar. 23, 1982 [GB] United Kingdom ..... 8208524

[51] Int. Cl.[3] ..... B26B 3/02

[52] U.S. Cl. ..... 204/192 C; 30/350; 204/192 N; 428/698

[58] Field of Search ..... 428/698, 194; 204/192 N, 192 C; 30/346.54, 350

[56] References Cited

U.S. PATENT DOCUMENTS

| | | | |
|---|---|---|---|
| 3,064,349 | 11/1962 | Futterer et al. | 30/350 X |
| 3,732,158 | 5/1973 | Przybyszewski et al. | 204/192 N |
| 3,900,636 | 8/1975 | Curry et al. | 148/4 X |
| 3,915,757 | 10/1975 | Engel | 30/346.54 X |
| 3,916,523 | 11/1975 | Lane et al. | 204/192 C |
| 3,975,891 | 8/1976 | Gunther | 30/350 X |
| 4,054,426 | 10/1977 | White | 204/192 N |

FOREIGN PATENT DOCUMENTS

| | | |
|---|---|---|
| 1380583 | 1/1975 | United Kingdom . |
| 1438654 | 6/1976 | United Kingdom . |
| 2063920 | 6/1981 | United Kingdom . |

*Primary Examiner*—Henry F. Epstein
*Attorney, Agent, or Firm*—Larson and Taylor

[57] ABSTRACT

An edged cutting implement is provided with a refractory material coating that terminates adjacent a cutting edge of the implement to improve its cutting performance by depositing the coating on the implement by means of ion plating under conditions such that the coating terminates adjacent a cutting edge of the implement so as not to cover the cutting edge.

4 Claims, No Drawings

COATINGS FOR CUTTING IMPLEMENTS

The invention relates to an edged cutting implement carrying a refractory material coating and a method of providing such a coating; the coating, which is provided by techniques such as sputter ion plating, terminates adjacent a cutting edge of the implement thereby to improve the cutting performance thereof.

There is much interest in improving the cutting performance of edged cutting implements both in terms of ability to cut and retention of ability to cut after extensive use. It is known to coat edged cutting implements such as cutting blades to improve their cutting performance; see, for example, U.K. Pat. No. 1,380,583. Such coatings, however, cover not only surfaces defining a cutting edge but also the cutting edge it self. The invention is concerned with coatings that do not cover the cutting edge itself, i.e. with coatings that terminate adjacent the cutting edge.

The invention includes an edged cutting implement carrying a refractory material coating terminating adjacent a cutting edge of the blade thereby to improve the cutting performance thereof.

The invention also includes a method of treating an edged cutting implement which comprises depositing a coating of a refractory material on the implement by means of ion plating under conditions such that the coating terminates adjacent a cutting edge of the implement thereby to improve the cutting performance thereof.

Thus, in the invention the coating does not completely cover the or at least one of the cutting edges of the implement. It has surprisingly been found that such an implement has an enhanced cutting performance in terms both of actual cutting ability and wear resistance when compared with an implement lacking such a coating or when compared with an implement carrying a coating covering a cutting edge, i.e. a coating not terminating adjacent that cutting edge.

By "adjacent" is meant that the coating terminates at such a distance from a cutting edge to give rise to improved cutting performance. The most appropriate distance from a cutting edge at which the coating terminates may vary depending on particular requirements. In some cases it may be appropriate for the coating to terminate almost at the cutting edge and in other cases it may be appropriate for the coating to terminate at a distance of the order of mm's from the cutting edge such as a distance of about $\frac{1}{2}$ mm.

An "implement" in this specification is not necessarily restricted to a final product but may, for example, include a part or parts for incorporation in a final product and for effecting a cutting operation in use of that product. Examples of implements are industrial cutting tools such as machine tools and lathe tools, milling cutters, taps and dies for cutting threads, knives and knife blades for industrial use (such as bread knives) and for domestic use.

By "coating" is not necessarily meant that the coating completely covers the implement, apart from a cutting edge thereof. Thus, to improve cutting performance, the implement need only have a coating on those parts of its surfaces that are involved in its cutting function and that define a cutting edge. Also, part of a cutting edge may be coated provided such partial coating does not impair improvement in cutting performance. Where the implement has more than one cutting edge, not all of the edges need necessarily have a coating terminating adjacent that edge. For example, one or more edges may lack such a coating or be completely coated, provided, of course, that at least one cutting edge has a coating terminating adjacent that edge.

The thickness of the coating may be varied and may be less that 1 μm, for example 0.1 μm, though it is possible that coatings of 1 μm thickness or greater may be suitable.

The coating technique used may be conventional ion plating or may be sputter ion plating. The latter is preferred for reasons given below.

Sputter ion plating is a coating technique where material is transferred from a cathode to a substrate in the presence of a DC glow discharge in a soft vacuum chamber and where material is generated from the cathode by the action of ion bombardment, i.e. sputtering, and ultimately diffuses to the substrate. Sputter ion plating is described in detail in a number of references in the art, for example, "Wire Industry", 44, December 1977, pages 771 to 777; Welding Institute Reprint, Advances in Surface Coating Technology International Conference, London 13–15 February 1978, pages 53–59; and Proceedings of 'IPAT' Conference, Edinburgh (June 1977) pages 177–186.

Generally, the main factors influencing the deposition of a coating by sputter ion plating are source power, gas pressure, bias voltage of sample being coated and sample temperature. The purpose of the bias is to attract ions (e.g. argon ions) to the sample during coating. The ions effectively polish the nascent coating to give a dense, uniform deposit. Since the electric field in sputter ion plating concentrates at any projections, edges, corners etc. of the sample, such regions are bombarded with a greater flux of ions than other regions of the sample. Also, since the solid angle of source material subtended from such regions is greater than that from other regions, more coating material (mostly atoms) arrives at such regions. Thus, there are two competing effects at an edge of a sample: a greater rate of accumulation of coating material, and a greater amount of "ion polishing" which tends to sputter material away from the edge. The former is fixed and the latter is variable by altering the bias voltage and hence the power. Normally in sputter ion plating, the bias power used is such that, compared with a flat region, the coating is slightly thicker at a corner of a sample but may be slightly thinner at a sharp edge of a sample. However, in the invention, sputter ion plating may be carried out using greater bias power (or current) than usual in order to prevent deposition of a coating at and near an edge (and also corners) of an edged cutting implement constituting the sample.

The reasons for preferring sputter ion plating are as follows. It can be used to deposit coatings of a range of different refractory materials; it can be used to deposit a uniform coating on large areas of an implement; it can be carried at low temperatures (e.g. ~300° C.) so as not to soften the implement; it gives rise to good adhesion of the coating on the implement; it has a readily controllable bias system, the value of which has been indicated above in the context of the invention. Also, sputter ion plating can operate at higher pressures than many other coating techniques and may use an unconfined glow discharge powered by large area source plates. There may, therefore, be a very large number of argon ions in the vicinity of a sample being coated. Only a small bias voltage is then necessary to attract sufficient ions to an edge of a sample to prevent deposition of a coating thereon.

The role of the coatings in the invention is not entirely understood. It is possible that the coating may reduce friction in use of the implement and/or harden a coated surface thereof. It is also possible that action of ions bombarding the implement causes sharpening of a cutting edge thereof when deposition of the coating has been carried out by sputter ion plating.

A wide range of refractory materials may be used in the invention. Particular example are nitrides such as TiN, ZrN and TiZrN since these may readily be deposited by carrying out sputter ion plating in a reactive environment such as a nitrogen containing environment. TiN has the additional advantage that coatings thereof have an attractive golden colour and may therefore be useful for coating cutting blades such as those of cutlery knives where a decorative finish may be valuable. Examples of other refractory materials which may be used are refractory carbides such as TiC, WC, Cr—C.

Several ways of carrying out the invention are described in detail below by way of example only.

EXAMPLE 1

Four stainless steel blades, each having a cutting edge angle of about 20°, were each provided with a titanium nitride coating of approximately 0.1 μm thickness by sputter ion plating. The apparatus and procedures used were described in U.K. patent application No. 80 36893 (Publication No. 2063920A), corresponding to U.S. patent application Ser. No. 208,776 filed Nov. 20, 1980 (Agents Reference 12663 M1H) and now abandoned. The specific process parameters of the sputter ion plating procedure were as follows:

The enclosure containing the samples and the source plates was preheated to 250° C. in pure argon prior to coating. During coating, the partial pressures of argon and nitrogen were 3.3 and 1.0 Pa respectively, the bias voltage was 50 V, the power dissipated in the titanium cathode plates was 560 watts and the coating time was 1½ hours.

Each of the four blades was found to have a gold-coloured TiN coating on the surfaces defining the cutting edge of the blade. The coating on each such surface terminated approximately ½ mm from the cutting edge of the blade and did not cover its corner.

The cutting performance of each blade so coated was assessed in standard cutting tests approved by the Cutlery Research Association. In one test the coated blades were each found to cut 80 sheets of cardboard; in comparison, similar but uncoated blades were found to cut 50 sheets of cardboard in the same test. In another test the coated blades were life-tested and found to be far superior to similar but uncoated blades.

EXAMPLE 2

A number of jobbing drills (¼" diameter) was ultrasonically cleaned in trichloroethylene to remove swarf and then vapour degreased in Genklene LV. The drills were then mounted in tubes approximately 2.5 cm long and closed at one end so that the shank end of the drill was loosely held to prevent coating of the area of the drill to be gripped by the chuck in subsequent use.

The mounted drills (up to 40) were positioned vertically in a succession of horizontal ranks in an enclosure for carrying out sputter ion plating as described in Example 1. The enclosure was preheated to 300° C. in pure flowing argon and the drills ion cleaned for 15 minutes using an accelerating voltage of 1000 V. The titanium cathode plates were sputtered using a power of 900 W and nitrogen was added to give a $N_2$ to Ar ratio of approximately 1 to 4. The bias voltage applied to the drills so that the cutting edges thereof were not coated was 80 V though this varies with the loading geometry for the enclosure.

The drills were each found to have a gold-coloured TiN coating that terminated adjacent the edge of the drill. The coating rate was approximately 0.1 μm/hour and the drills were coated for 1.5 hours and 10 hours respectively.

We claim:

1. A method of treating an edged cutting implement which comprises depositing a coating of a refractory material on the implement by means of sputter ion plating, said sputter ion plating being carried out using a sufficiently high bias current to prevent deposition of the coating at and near an edge of the edged cutting implement.

2. A method as claimed in claim 1 wherein the refractory material is titanium nitride.

3. A method as claimed in claim 1 wherein the implement is in the form of a knife blade.

4. A method as claimed in claim 1 wherein the implement is in the form of a drill.

* * * * *